US007777112B2

(12) United States Patent
O'Connor

(10) Patent No.: US 7,777,112 B2
(45) Date of Patent: Aug. 17, 2010

(54) METHOD AND APPARATUS FOR TUNING A MUSICAL DRUM

(76) Inventor: Thomas O'Connor, 800 SE. 20th Ave., Apt. 511, Deerfield Beach, FL (US) 33441

( * ) Notice: Subject to any disclaimer, the term of this patent is extended or adjusted under 35 U.S.C. 154(b) by 29 days.

(21) Appl. No.: 11/900,068

(22) Filed: Sep. 10, 2007

(65) Prior Publication Data

US 2009/0064844 A1 Mar. 12, 2009

(51) Int. Cl.
*G10D 13/02* (2006.01)

(52) U.S. Cl. ..... 84/411 R; 84/411 A

(58) Field of Classification Search ..... 84/411 R, 84/411 A, 413
See application file for complete search history.

(56) References Cited

U.S. PATENT DOCUMENTS

| | | | | |
|---|---|---|---|---|
| 4,208,942 | A | 6/1980 | Henrit | |
| 4,218,952 | A | 8/1980 | Arbiter | |
| 4,228,721 | A | 10/1980 | Hancox | |
| 4,694,726 | A | 9/1987 | Silvestri | |
| 4,741,242 | A | 5/1988 | Aronstein | |
| 4,870,883 | A | 10/1989 | Gauger | |
| 5,025,697 | A | 6/1991 | May | |
| 5,392,681 | A | 2/1995 | Hall | |
| 5,394,775 | A | 3/1995 | Fagerstrom | |
| 5,442,988 | A | 8/1995 | Mayo | |
| 5,739,448 | A | 4/1998 | Toscano | |
| 5,977,463 | A | 11/1999 | Bartlett | |
| 6,026,521 | A * | 2/2000 | Atkins | 4/252.4 |
| 6,043,419 | A | 3/2000 | Arbiter | |
| 6,242,680 | B1 | 6/2001 | Benton | |
| 6,407,322 | B1 | 6/2002 | Kuppers | |
| 6,586,665 | B1 | 7/2003 | Liao et al. | |
| 6,700,046 | B2 | 3/2004 | Cherbettchian | |
| 6,812,392 | B2 | 11/2004 | Brando | |
| 7,009,099 | B1 | 3/2006 | Belli | |
| 7,074,994 | B2 | 7/2006 | Belli | |
| 7,138,574 | B1 * | 11/2006 | Spinazzola | 84/411 R |
| 2002/0184991 | A1 | 12/2002 | Brando | |
| 2002/0184992 | A1 | 12/2002 | Brando | |
| 2003/0159550 | A1 | 8/2003 | Shigenaga | |
| 2004/0031375 | A1 | 2/2004 | Hayden | |
| 2004/0094015 | A1 | 5/2004 | Simons et al. | |
| 2004/0159209 | A1 | 8/2004 | Henry | |
| 2005/0016357 | A1 | 1/2005 | Punchard | |
| 2005/0056137 | A1 | 3/2005 | DiPietro | |
| 2006/0060061 | A1 | 3/2006 | Henry | |

* cited by examiner

*Primary Examiner*—Jianchun Qin
(74) *Attorney, Agent, or Firm*—Jacqueline Tadros, P.A.; Jacqueline Tadros

(57) ABSTRACT

A drumhead with an outer ring member anchored to the outer periphery of a drum and having a threaded interior surface. An inner ring member having a threaded exterior surface matingly threaded to the interior surface of the outer ring. Rotating the inner ring in a first direction relative to the outer ring, increases the tension exerted on the drum skin. Similarly, rotating the inner ring in a second direction relative to the outer ring decreases the tension exerted on the drum skin. Vertical pressure is exerted on the drum skin and drum ring when the inner ring is rotated in a first direction relative to the outer ring. Conversely, the pressure is released on the drum skin and the drum ring when the inner ring is rotated in a second direction relative to the outer ring.

10 Claims, 10 Drawing Sheets

METHOD AND APPARATUS FOR TUNING A MUSICAL DRUM

FIELD OF THE INVENTION

The invention relates generally to the field of musical percussion instruments and more particularly to a drumhead tuning apparatus for the tensioning of a drumhead.

BACKGROUND OF THE INVENTION

A drumhead generally includes a drum skin held in contact with a circular rim. The tension on the drum skin is adjusted to fine tune the pitch of the drum. Typically, adjusting the tension entails either tightening or loosening multiple lug bolts located on the exterior of the drum body.

It is often necessary to adjust each of the lug bolts individually, since either tightening or loosening of even a single lug bolt will affect the drum skim tension, such that the other lug bolts must also each correspondingly be adjusted as well in order to obtain a consistent sound throughout the entire drumhead. Thus, the tuning of a musical drum via conventional tensioning mechanisms is quite often time consuming.

Thus the concept of quick tuning drums is known and was introduced in the prior art to address the time consuming and sometimes cumbersome conventional methods of tuning a drum.

One example is the roto-tom. A roto-tom usually has only one drumhead held against an abbreviated length shell by a hoop, which hoop pulls the head tightly against the shell. Tension rods are spaced around the hoop, such that when the entire drum is rotated, the tension rods collectively tighten thereby uniformly pressuring the drumhead against the shell. As a result, rotating the drum in one direction tightens the drumhead and counter-rotating the drumhead decreases the head tension.

Another method of quickly changing the pitch of drums is disclosed in U.S. Pat. No. 4,218,952 (to Arbiter) and U.S. Pat. No. 5,739,448 (to Toscano) which disclose drum tensioning devices that employ gears which tighten a counter hoop which tightens the skin of the drum as the gears are rotated.

The '448 patent (to Toscano) utilizes an inverted J-shaped counterhoop that is threadably engaged with an externally threaded, outwardly facing tuning rim surface on a tuning collar that is secured to the drum shell. A pressure ring bears downwardly on a hoop that is secured to the periphery of the drum skin. Rotation of the counterhoop in one direction screws the counterhoop further onto the drum shell, thereby tightening the drum skin. Counterrotation of the counterhoop in the opposite direction loosens the drum skin.

U.S. Pat. No. 6,043,419 (to Arbiter) discloses a drum including a drum shell, a drumhead, a counter-hoop and a shell hoop. An adjustable clamp ring engages the counterhoop and the rim of the shell hoop through correspondingly inclined portions. The clamp ring has a breach and a tightening mechanism so that when the clamp ring is tightened, the counter-hoop is forced downwards, thereby tightening the skin.

U.S. Pat. No. 6,586,665 (to Liao et al) teaches a drum membrane which is adjustable to different tensions which utilizes a tensioning ring that works in conjunction with a bolt or fastener. A follower linked to the adjusting bolt forces a pair of blocks toward and away from one another in order to adjust the tension of the skin head held by the ring.

In view of the foregoing, there is a need for an improved drum tuning device which is easy and quick to use, which provides uniform tuning around the perimeter of the drumhead. The device should be easily adapted for use on any conventional drum and should not be obtrusive so that it does not interfere with the freedom of movement of the drummer during play.

SUMMARY OF THE INVENTION

The apparatus of the present invention utilizes a drumhead with a fixed outer ring member anchored to the outer periphery of a drum and having a threaded interior surface. A rotatable inner ring member having a threaded exterior surface is matingly threaded to the interior surface of the outer ring.

When the inner ring is rotated in a first direction relative to the outer ring, the tension exerted on the drum skin increases. Similarly, when the inner ring is rotated in a second direction relative to the outer ring, the tension exerted on the drum skin decreases.

In a preferred embodiment, the inner ring includes an upper and lower member. The lower inner ring rests on top of the drum skin and beneath the upper inner ring. The lower inner ring absorbs vertical pressure exerted on the drum skin when the upper inner ring is rotated in a first direction relative to the outer ring. The upper and lower inner ring are configured to matingly interconnect with the top portion of the lower inner ring preferably configured in the shape of the letter "J".

In an alternative embodiment, the upper inner ring and lower ring are separated by ball bearings. As the threaded upper inner ring rotates relative to the fixed outer ring, the upper inner ring is screwed further downward or upward relative to the outer ring. As the upper inner ring is screwed downward, the upper inner ring exerts downward pressure on the ball bearings relative to the lower inner ring. As the inner ring is screwed upward, pressure on the ball bearings is released.

In a further embodiment, the inner ring includes recessed notches or gear teeth on its top surface. A mechanism in contact with the notches or gear teeth of the inner ring is then used to turn the inner ring relative to the outer ring, such that when the inner ring is turned in a first direction, tensioning pressure is applied to the drum skin ring and when the inner ring is turned in a second direction, tensioning pressure is released from the drum skin.

In yet a further embodiment, the outer ring is "L" shaped and a plurality of allen key holes are positioned on the lower base of the interior surface of the outer ring. Each allen key hole receives a bolt which connects the lower base of the outer ring to an anchor on the exterior side of the drum shell. When the nut is loosened from the bolt, the bolt slides to the end of the allen key hole releasing the outer ring to allow for repositioning or replacing the drum skin.

An advantage of the present invention is to provide a simple method and apparatus to adjust the tension on a drumhead for tuning a drum.

An object of the present invention is to provide a system in which uniform tension can be applied to tune a drum.

Another object of the present invention is to provide a system in which tension on a drumhead may be adjusted at various points along the circumference of the drumhead in order to compensate for imperfections in a drum shell or drum skin.

An advantage of the present invention is that the tightening or loosening of a drumhead skin may be accomplished by turning a threaded outer ring relative to a correspondingly mated threaded inner ring.

Yet another object of the present system is to simplify the procedure of tuning a drum.

The present invention is easily incorporated into any conventional drum or like percussion instrument.

There has thus been outlined, rather broadly, the more important features of the invention in order that the detailed description thereof may be better understood, and in order that the present contribution to the art may be better appreciated. Other features and advantages of the present invention will become apparent from the following more detailed description, taken in conjunction with the Brief Description of the Drawings and accompanying drawings, which illustrate, by way of example, the principles of the invention, as well as the Detailed Description of the Invention and Claims appended herewith.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DETAILED DESCRIPTION OF THE INVENTION

Figure 1A:
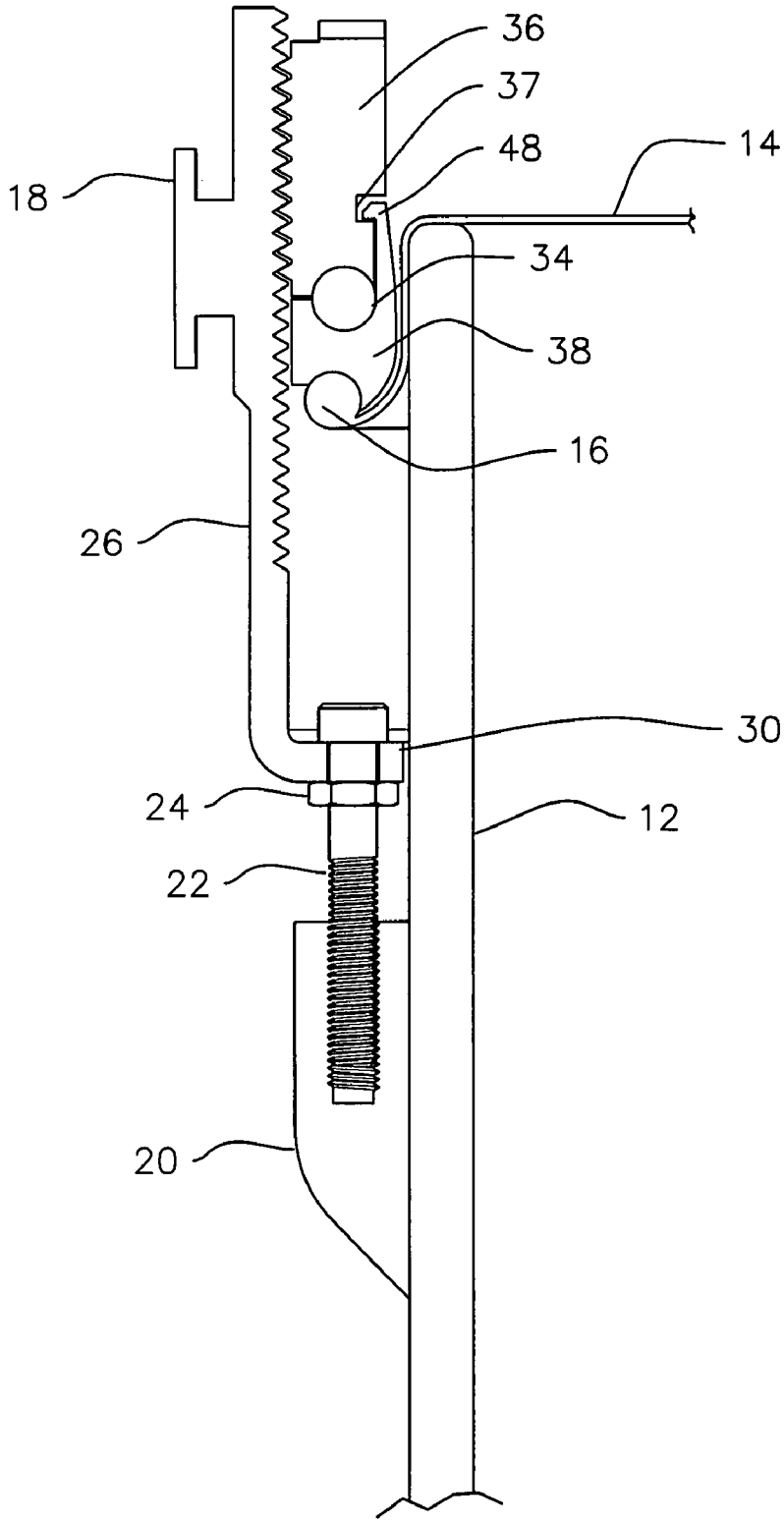
FIGS. 1A-1B illustrate a side cut view of the system of the present invention.
Figure 1B:
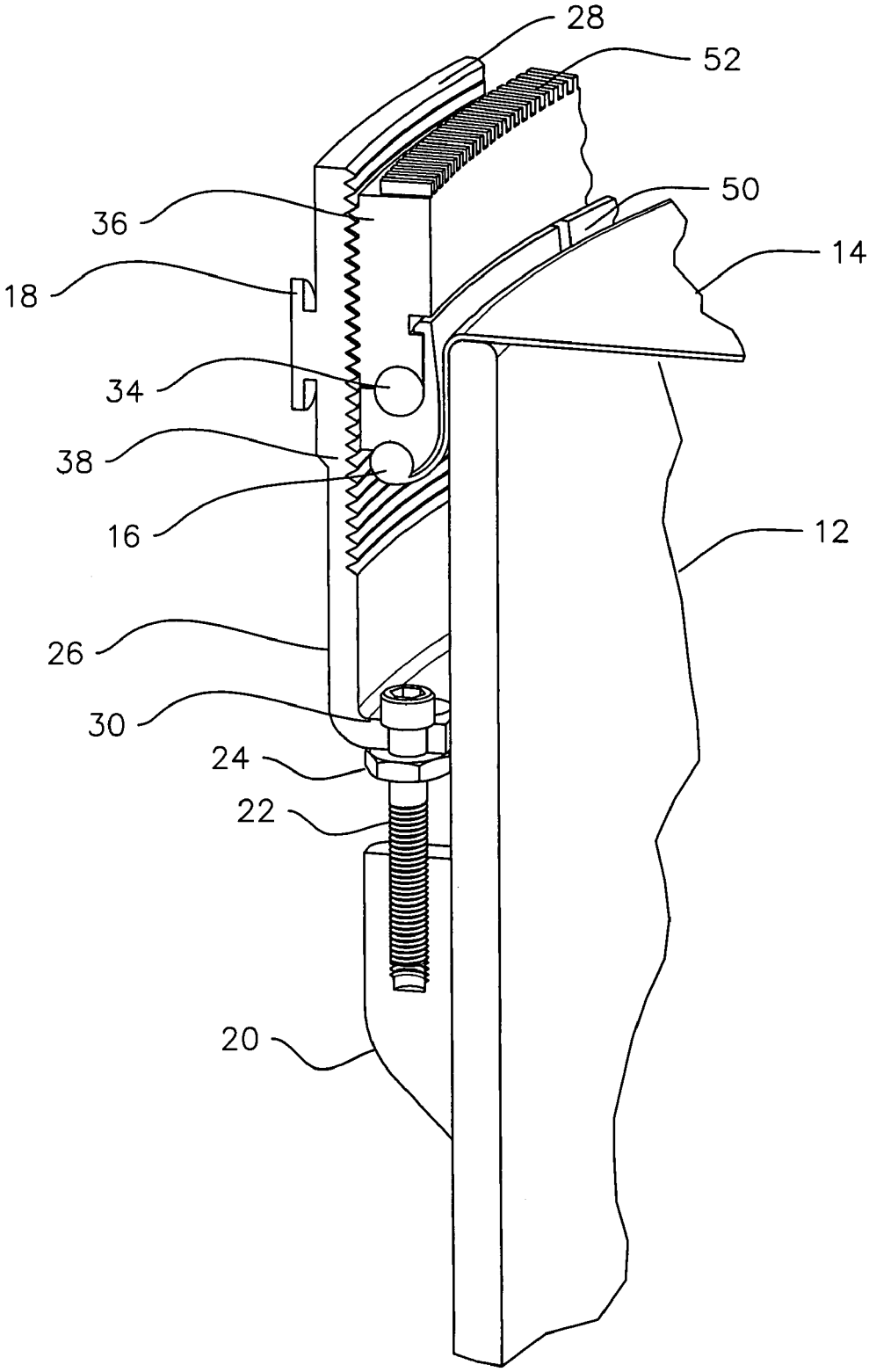

The present invention is described with references to the enclosed Figures wherein the same numbers are utilized where applicable.

In one embodiment, the present invention provides a method and apparatus for tuning a drum. The drum includes a drum shell 12, a drum skin 14 and a drum ring 16.

The drum comprises a cylindrical drum shell 12 having an opening at each end. The drum skin 14 is stretched over one of the openings with the drum ring 16 being sized to fit over the shell 12 at one end to retain the drum skin 14 between the drum shell 12 and the drum ring 16.

A plurality of anchor posts 20 are mounted to the exterior of the drum shell 12. The anchor posts 20 include threaded apertures (not shown) for receiving threaded set screws or bolts, for example a hex bolt 22.

Figure 2:
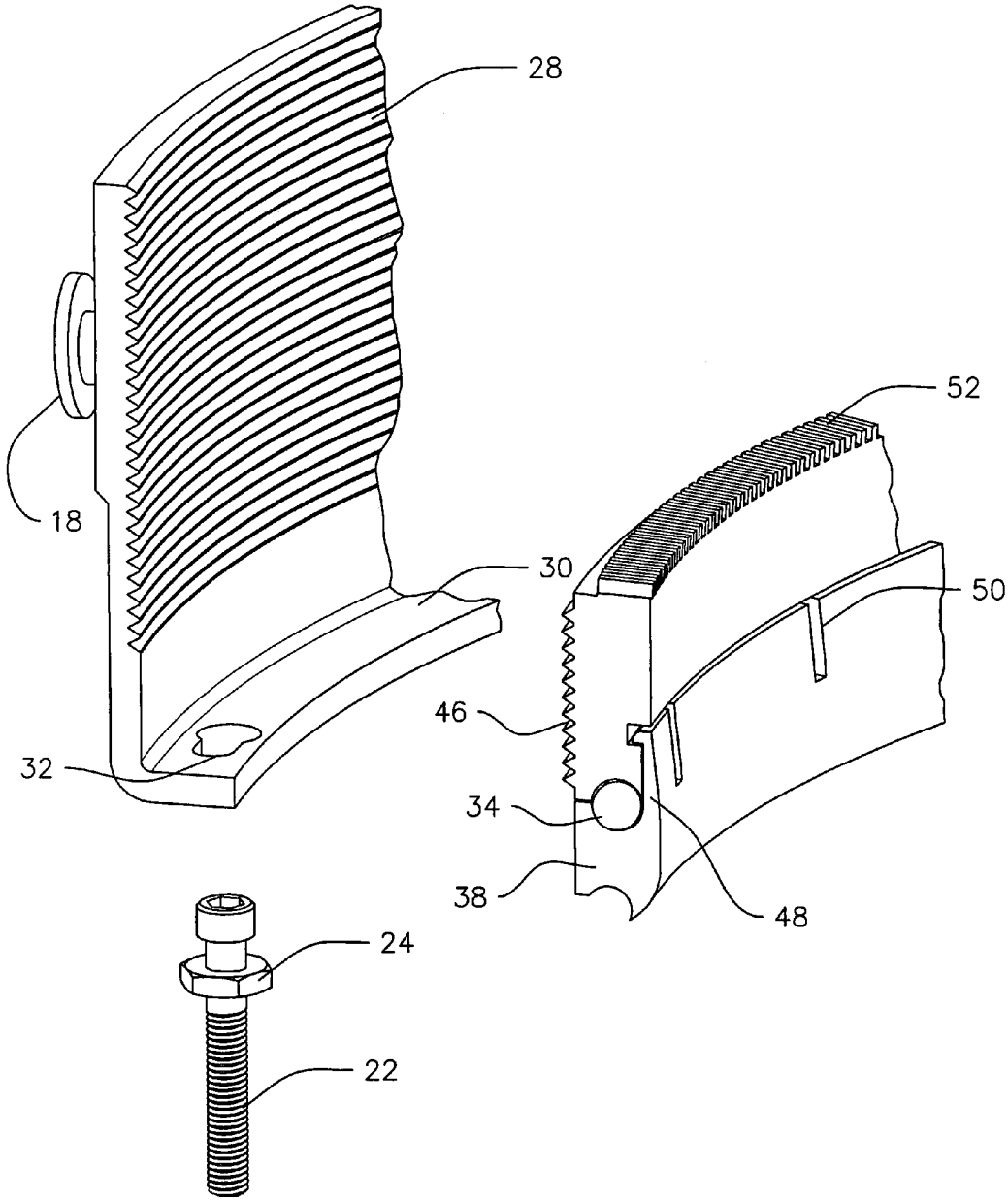
FIG. 2 illustrates an exploded view of some of the components of the present invention.
Figure 3A:
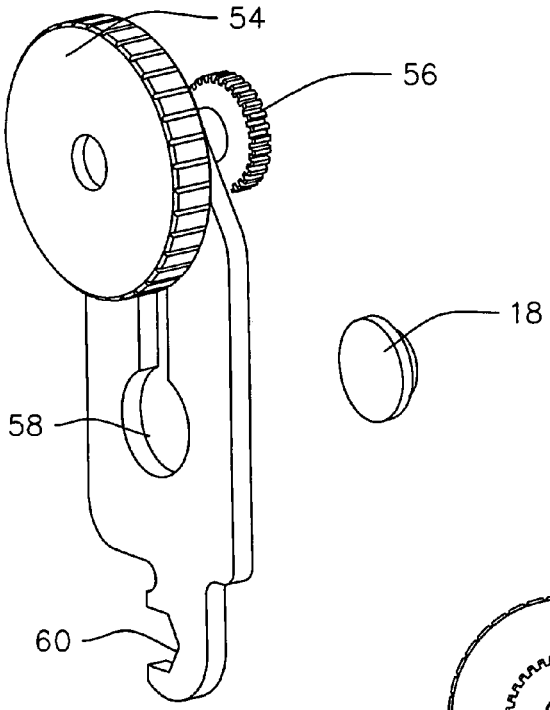
FIG. 3A illustrates a side perspective view of an embodiment of the tuner of the present invention.
Figure 3B:
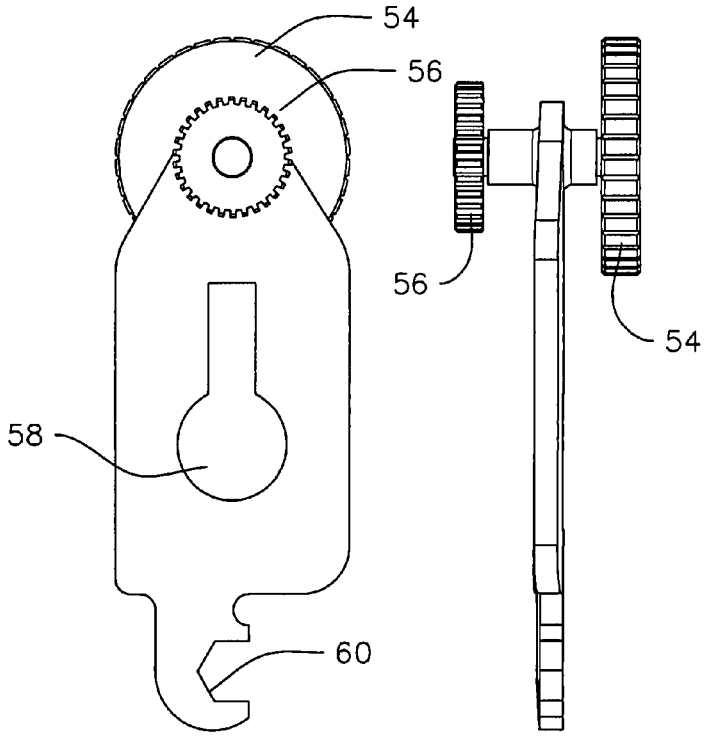
FIG. 3B illustrates a front and side view of an embodiment of the tuner of the present invention.
Figure 3C:
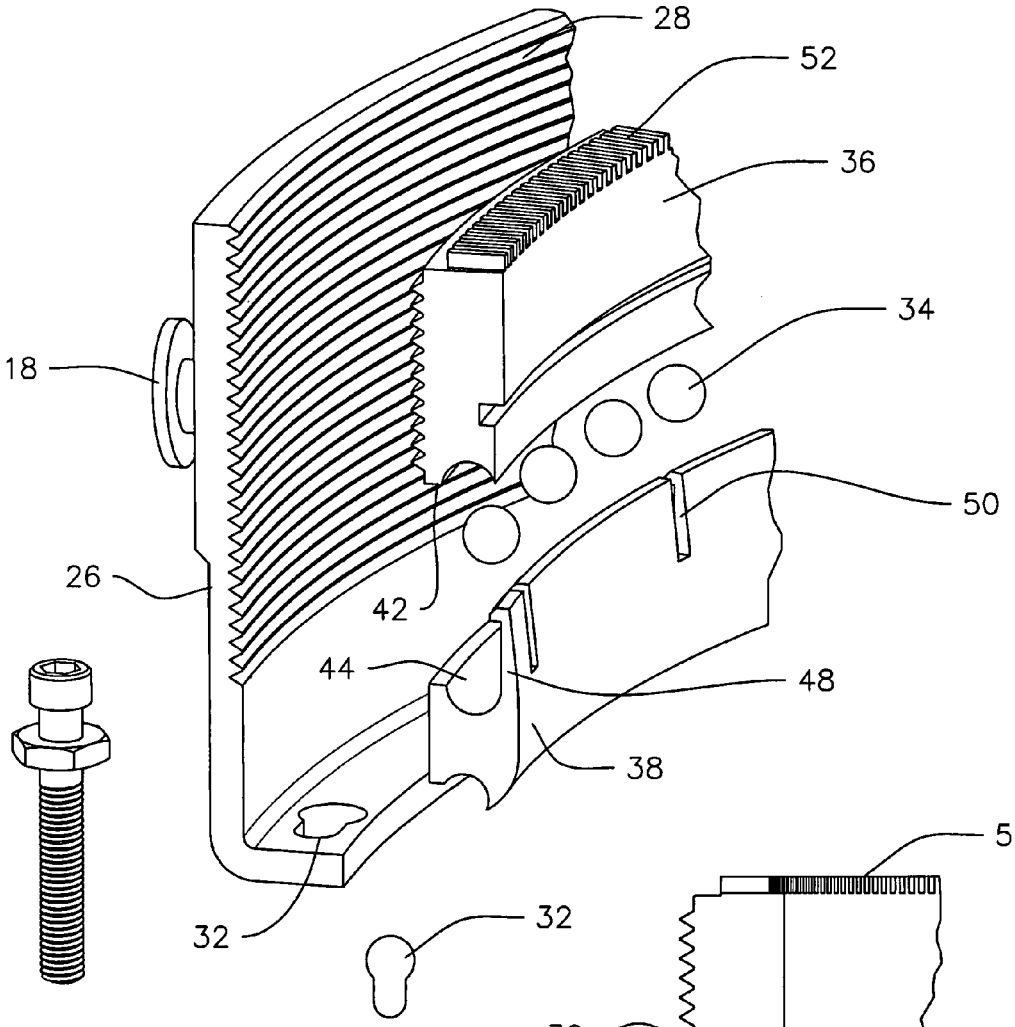
FIG. 3C illustrates a partial cut side view of some of the components of the present invention, including the outer and inner ring.
Figure 3D:
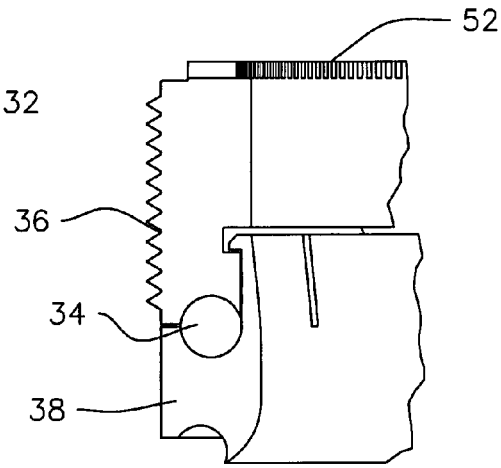
FIG. 3D illustrates a partial cut side view of the upper and lower inner ring of the present invention cooperatively linked.
Figure 4A:
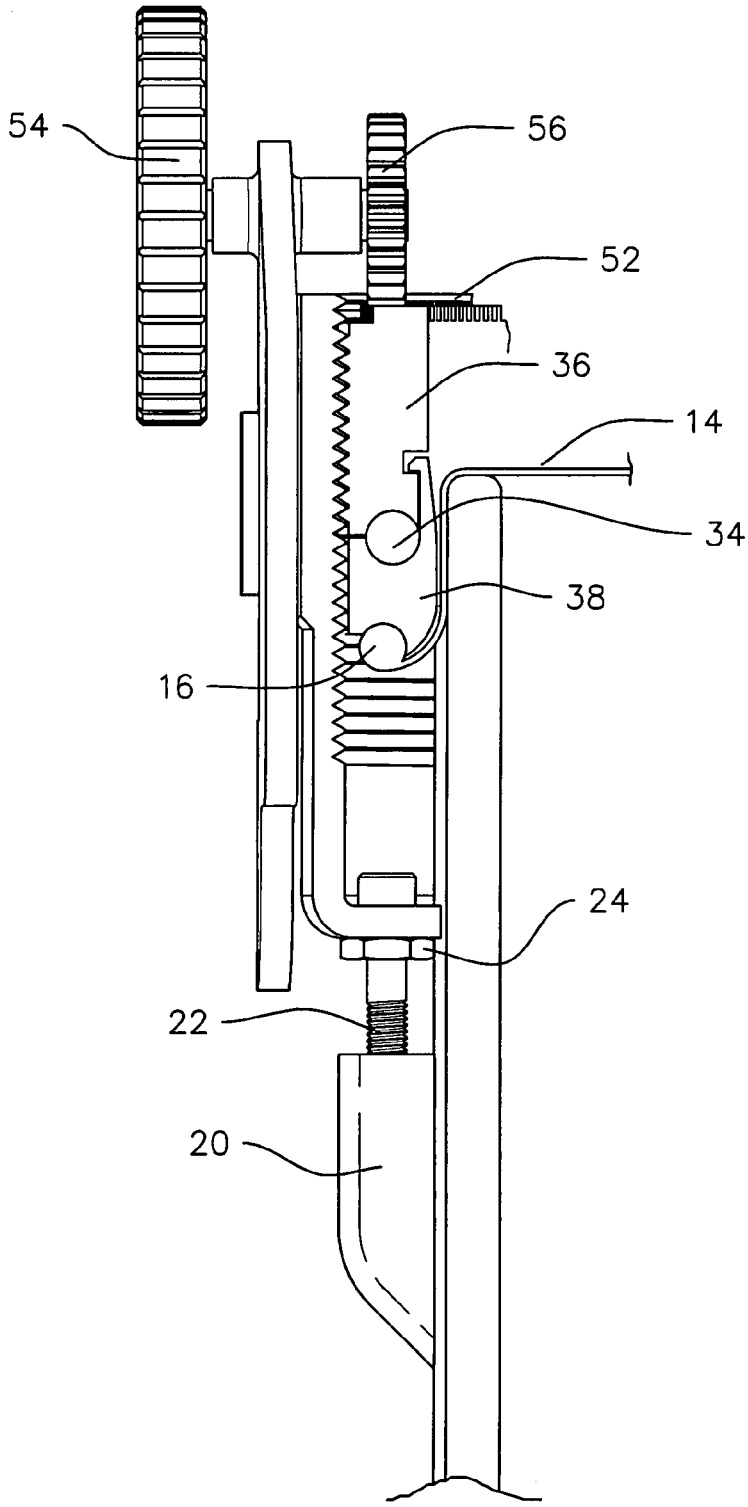
FIG. 4A illustrates a side view of an embodiment of the tuner of the present invention in cooperation with the inner ring of the present invention.
Figure 4B:
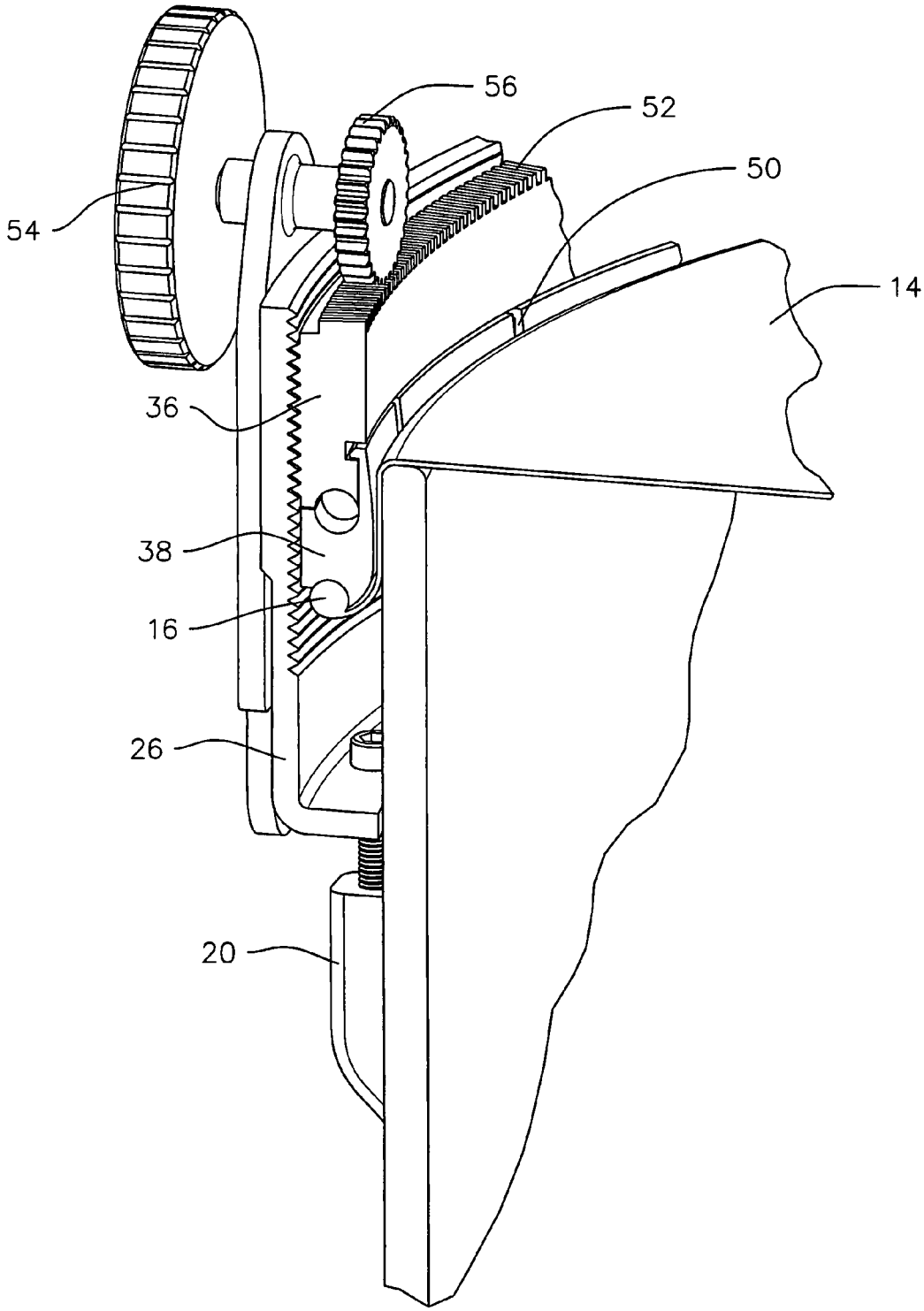
FIG. 4B illustrates a side perspective view of an embodiment of the tuner of the present invention in cooperation with the inner ring of the present invention.
Figure 5B:
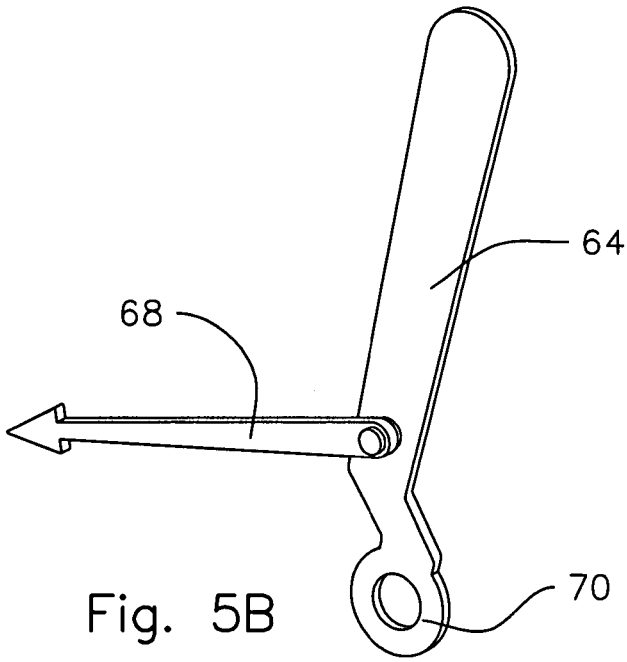
FIGS. 5A-5B illustrate side views of an alternative embodiment of the tuner of the present invention.
Figure 5A:
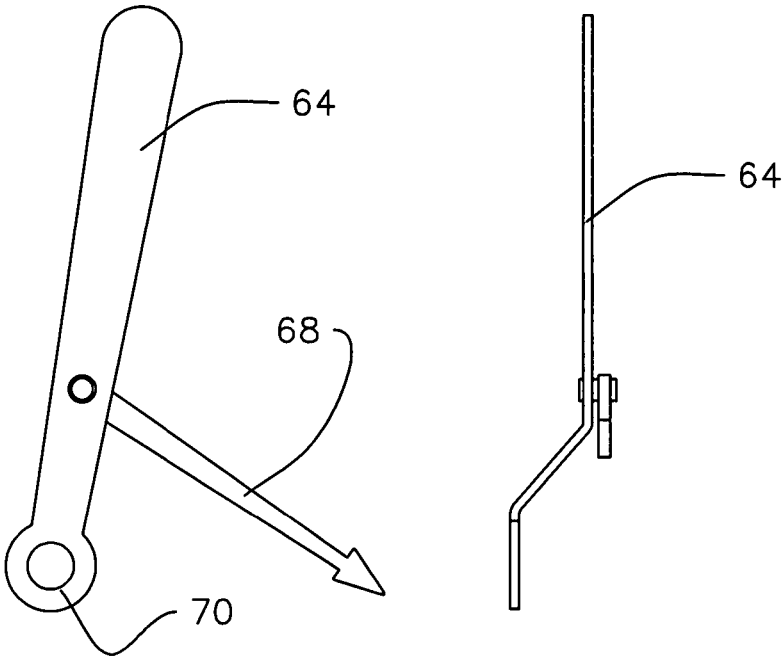

An L-shaped outer ring 26 is affixed to the anchor posts 20 of the drum shell 12 via drum lug nuts, set screws or bolts, for example hex bolts 22 and hex nuts 24. A plurality of allen key holes 32 are positioned along an inner lip 30 of the outer ring 26 for receiving the bolts 22. Each allen key hole has an enlarged hole region and a narrow hole region as is shown in FIG. 2 and FIG. 3C.

An off set wrench 60 may be used to adjust the nuts 24 and bolts 22. In loosening the nuts 24 and bolts 22 of the assembled drum of the present invention, the outer ring 26 may be rotated to slide the bolts 22 in a first direction within the allen key holes 32 toward the enlarged portion of the allen key hole 32. This maneuver allows for the removal, adjustment and/or replacement of the drum skin 14 of the drum without having to completely detach the outer ring 26 from the drum shell 12 or otherwise disassemble the drum. Adjustment or replacement of a drum skin 14 will vary the tune or pitch of a drum, as is appreciated by those skilled in the art.

An inner ring comprises upper 36 and lower 38 inner ring portions, divided by ball bearings 34. The upper inner ring 36 has a threaded exterior surface 46 that is matingly threaded to a threaded interior surface 28 of the outer ring 26.

The lower portion 38 of the inner ring comprises a cylindrical sleeve (not shown) having an arcuate upper 42 and arcuate lower surface 44. Referring to FIGS. 1A, 1B, 2, 3C, 3D, 4A and 4B, the upper arcuate surface 42 mates with a plurality of ball bearings 34. The lower arcuate surface 44 mates with the drum ring 16.

As shown in FIGS. 1A-2 and FIGS. 3C-4B, the top portion of the lower inner ring 38 has the shape of a J-shaped appendage 48. The J-shaped appendage 48 cooperatively mates with the upper inner ring 36 along an indentation 37 which runs along the circumference of the inner perimeter. The J-shaped appendage 48 is cut at an angle in order to promote fluid movement and interaction between the upper inner 36 and lower inner 38 rings.

The exterior surface of the upper inner ring 36 includes male threading 46 that mates with the female threading 28 on the exterior surface of the outer ring 26. The upper inner ring 36 is rotated in a first direction relative to the stationary outer ring 26. Thus, when the upper inner ring 36 is rotated in a first direction relative to the outer ring 26, tensioning pressure is applied to the drum skin ring 16, the ball bearings 34 and the lower inner ring 38. Conversely, when the upper ring 36 is rotated in a second direction relative to the stationary outer ring 26, tensioning pressure is released from the drum skin ring 16, the ball bearings 34 and lower inner ring 38. The consequent increase or decrease in tensioning pressure increases or decreases the pressure on the drum skin 16. As is appreciated by those in the art, variations in pressure applied to the drum skin 16 affects the tone and pitch of the drum.

A plurality of evenly spaced relief cuts 50 are positioned along an interior circumference of the lower inner ring 38 to provide flex as the upper inner ring 36 is rotated relative to the outer ring 26 and relative to the lower inner ring 38.

In an alternative embodiment, the upper edge of the upper inner ring 36 includes 52, the grooves for example, may include gear threadings, gear teeth or recessed notches. Thus, a tuning tool with a wheel 54 and gear teeth 56 may be used to engage grooves 52 in the shape of gear teeth. The gear 56 of the tuning tool interact with grooves 52 on the upper surface of the upper inner ring 36 for rotating the upper inner ring 36 relative to the outer ring 26 and the lower inner ring 38. The grooves 52 may be a variety of geometric shapes or sizes as may be appreciated by those in the art As shown in FIGS. 3A, 3B, 4A and 4B, a tuning tool with a wheel 54 and gear teeth 56 is used to drive the upper inner ring 36 relative to the outer ring 26 in a first direction. As the threaded upper inner ring 36 rotates against the threaded interior surface 28 of the outer ring 26 the mating threadings 46 and 28, further mesh together, driving the upper inner ring 36 downward and creating a downward force against the ball bearings 34. This drives the inner lower ring 38 further downward thus increasing pressure on the drum ring 16 and the drum skin 14.

Conversely, if the tuning tool is moved in a second and opposite direction, the threaded upper inner ring 36 rotates away from the outer ring 26, thus the mating threadings 46, 28 of the upper inner 36 and the outer ring 26 are driven apart, releasing the pressure on the ball bearings 34. In this manner, the tension on the drum skin 14 is varied. As is known by those skilled in the art, the increase and decrease of tension on the drum skin 14 affects tone and pitch.

In a preferred embodiment, the tuning tool includes the off set wrench 60 for fine tuning and an aperture 58 for clipping the tuning tool to the outside ring 26.

Figure 6A:
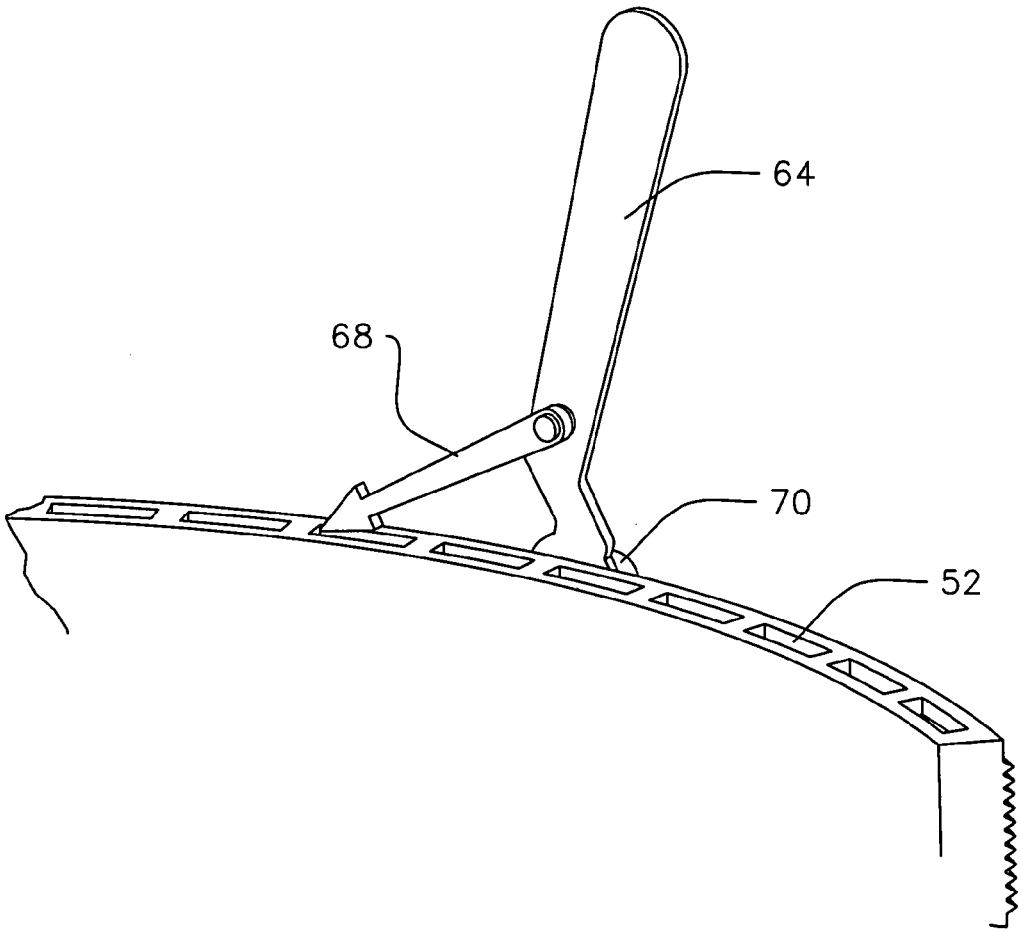
FIG. 6A illustrates an embodiment of the tuner of the present invention in cooperation with recessed notches of the upper inner ring.
Figure 6B:
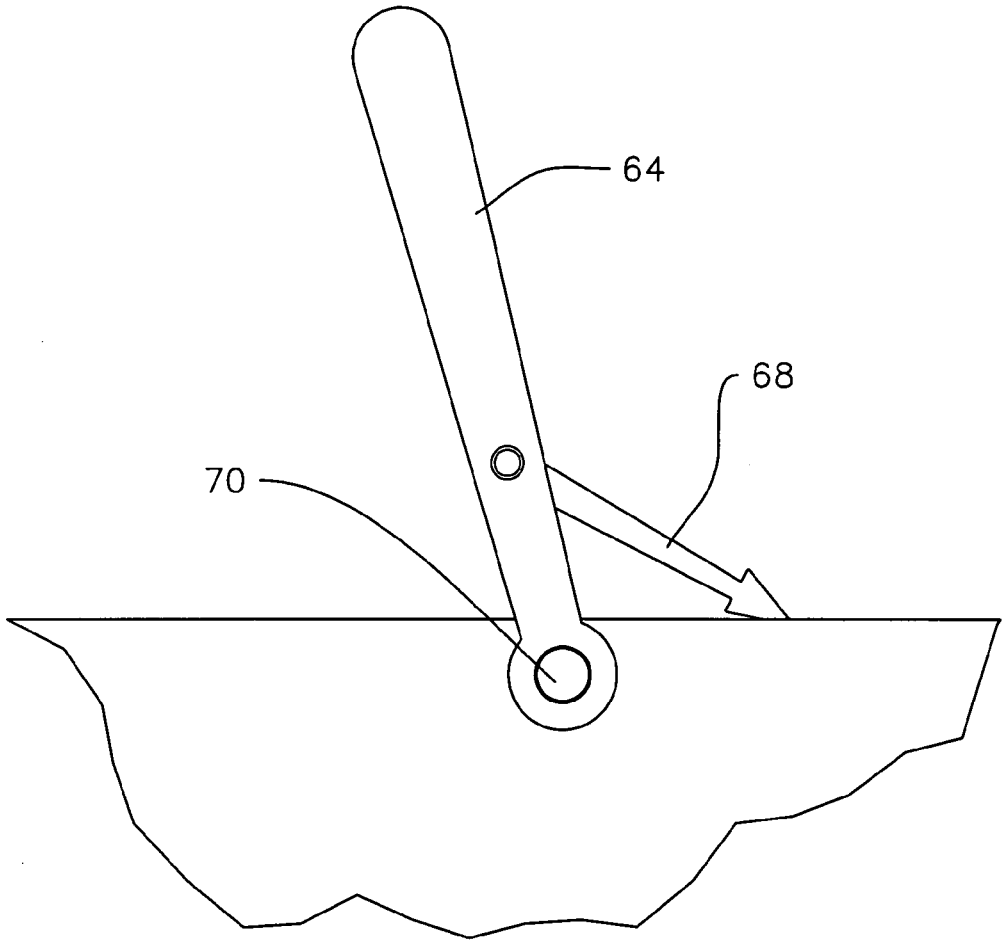
FIG. 6B illustrates a side view of an embodiment of the tuner of the present invention mounted to the exterior surface of the outer ring with the arrow head of the tuner in cooperation with the upper inner ring.

In an alternative embodiment, a tuning tool is positioned on the outer ring 26 as shown in FIG. 6B. The tuning tool includes a lever 64 with a swinging arm with arrow head 68. Thus, when the lever 64 is moved in a first direction, the upper inner ring 36 is rotated in a first direction. Conversely, when the lever 64 is moved in a second direction, the upper inner ring 36 is rotated in a second direction. The arrow head of the swinging arm 68 catches and engages a groove 52 in the shape of a rectangular recessed notch on the upper inner ring 36, the groove 52 being designed to engage the tip of the arrow head of the swinging arm 68 as is known by those in the art.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. An apparatus for tuning a musical instrument including a drum shell having an opening formed therein and a drum skin covering the opening and attached to a drum ring, the tuning apparatus comprising:

an inner ring comprising an upper inner ring having threaded exterior surface and a lower inner ring separated by a ball bearing;

an outer ring having a threaded interior for mating with the exterior threading of the upper inner ring;

means for moving the upper inner ring and the lower inner ring relative to the drum shell and the outer ring; and wherein the moveable inner ring is disposed between the drum shell and the outer ring and geared threading at the top of the upper inner ring is adapted for receiving a tool for tuning the apparatus.

2. The tuning apparatus of claim 1, wherein at least one anchor post having screw receiving means located below the opening of the drum shell;

the outer ring having at least one hole for removably and adjustably connecting the anchor post to the drum shell with a bolt, whereby the outer ring is connected to the anchor post with the bolt and the anchor post is further connected to the drum shell; and wherein the means for moving the drum ring include a gear threading disposed on a top surface of the upper inner ring and capable of tuning the musical instrument by moving the upper inner ring relative to the drum shell and the outer ring.

3. A tunable drum comprising:

a drum shell having an opening formed therein;

a skin covering the opening and attached to the drum shell;

a moveable inner ring comprising an upper inner ring having threaded exterior and a lower inner ring separated by a ball bearing;

a moveable drum ring holding the skin disposed underneath the lower inner ring;

an outer ring attached to the drum shell having a threaded interior for matingly holding the upper inner ring having exterior threading;

means for moving the inner ring relative to the drum shell and the outer ring; and wherein the moveable inner ring is disposed between the drum shell and the outer ring and geared threading at the top of the upper inner ring is adapted for receiving a tool for tuning the apparatus.

4. A tunable drum of claim 3, wherein the means for moving the drum ring include a geared threading disposed on a top surface of the upper inner ring and capable of tuning the musical instrument by moving the inner ring relative to the drum shell and the outer ring.

5. An inner ring for tuning a musical instrument, comprising:

an upper inner ring and a lower inner ring and a ball bearing disposed therebetween;

a drum shell having an opening formed therein;

a skin covering the opening and attached to the drum shell;

an outer ring for assisting the movement of the inner ring fixedly disposed around the drum shell;

a moveable drum ring disposed over the skin and around the drum shell;

means for moving the drum ring relative to the drum shell and the outer ring; and wherein the moveable inner ring is disposed between the drum shell and the outer ring and geared threading at the top of the upper inner ring is adapted for receiving a tool for tuning the apparatus.

6. The inner ring of claim 5, wherein the means for moving the drum ring include a gear threading disposed on a top surface of the upper inner ring and adapted for receiving a tool for tuning the musical instrument.

7. The inner ring of claim 5, wherein the outer ring attached to the drum shell having a threaded interior for matingly holding the inner ring having exterior threading in the upper portion.

8. The inner ring of claim 5, wherein the lower inner ring comprises a J-shaped appendage.

9. The appendage of claim 8, wherein the appendage comprising an arcuate top surface and an arcuate bottom surface.

10. The J-shaped appendage of claim 8, wherein the appendage cooperatively mates with the upper inner ring along an indentation disposed on an inner perimeter.

* * * * *